US010040089B2

(12) United States Patent
Xue et al.

(10) Patent No.: US 10,040,089 B2
(45) Date of Patent: Aug. 7, 2018

(54) VEHICLE WHEEL SPRAYING SUPPORT TOOL

(71) Applicant: CITIC Dicastal CO., LTD., Qinhuangdao, Hebei (CN)

(72) Inventors: Bowen Xue, Qinhuangdao (CN); Jiandong Guo, Qinhuangdao (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 0 days.

(21) Appl. No.: 15/604,238

(22) Filed: May 24, 2017

(65) Prior Publication Data

US 2017/0348720 A1 Dec. 7, 2017

(30) Foreign Application Priority Data

Jun. 1, 2016 (CN) ..... 2016 1 0381210

(51) Int. Cl.
*B05B 13/02* (2006.01)

(52) U.S. Cl.
CPC ..... *B05B 13/0285* (2013.01)

(58) Field of Classification Search
USPC ..... 118/500; 254/50.2
See application file for complete search history.

(56) References Cited

U.S. PATENT DOCUMENTS

| | | | | |
|---|---|---|---|---|
| 223,618 A | | 1/1880 | Warrington | |
| 1,352,601 A | * | 9/1920 | Hawkinson | B60C 25/142 254/50.2 |
| 4,887,771 A | | 12/1989 | Marlek | |
| 9,427,849 B2 | * | 8/2016 | McMillan | B25B 5/16 |

FOREIGN PATENT DOCUMENTS

| | | | | |
|---|---|---|---|---|
| CN | 201841082 U | | 5/2011 | |
| CN | 104174520 A | | 12/2014 | |
| CN | 104923429 A | * | 9/2015 | B05B 13/0285 |
| CN | 205659833 U | | 10/2016 | |
| GB | 104464 A | | 3/1917 | |

* cited by examiner

*Primary Examiner* — Yewebdar T Tadesse
(74) *Attorney, Agent, or Firm* — Syncoda LLC; Feng Ma; Junjie Feng

(57) ABSTRACT

An improved vehicle wheel spraying support tool is provided. The improved vehicle wheel spraying support tool is composed of a base plate, rotary sleeves, adjustment rods, supporting pins, a stationary sleeve, a flange, fixed plates and the like. In use, the rotary sleeves with random number are mounted in a slot of the base plate and a slot of the flange through sliding pins according to requirements; after angles among the supporting pins are adjusted, the rotary sleeves are fixed through screws III; the positions of the supporting pins can be adjusted to fit in vehicle wheels of different pitch circles by adjusting the positions of the adjustment rods in the rotary sleeves; and the vertical heights of the supporting pins can be adjusted through threads of the lower parts of the supporting pins, and the supporting pins are locked through locking nuts. The improved vehicle wheel spraying support tool provided by the disclosure can meet the on-line spraying requirements of special forged vehicle wheels with different pitch circle diameters, different heights and different sizes, not only has a simple structure and high universality, but also has the characteristics of safety, reliability, low manufacturing costs and the like.

2 Claims, 3 Drawing Sheets

VEHICLE WHEEL SPRAYING SUPPORT TOOL

CROSS-REFERENCE TO RELATED APPLICATIONS

This application is filed based upon and claims priority to Chinese Patent Application No. 201610381210.9, filed on Jun. 1, 2016, the entire contents of which are incorporated herein by reference.

TECHNICAL FIELD

The disclosure relates to a spraying support tool, and in particular to an improved universal vehicle wheel spraying support tool.

BACKGROUND

Currently, a vehicle wheel needs to be designed into a two-piece combination type in order to meet the functional requirements of some customers. Compared with the traditional one-piece vehicle wheel, such two-piece combination type vehicle wheel has a greatly different process in each working procedure, such as the spraying procedure, wherein a back cavity of the two-piece combination type vehicle wheel needs to be sprayed with uniform and consistent color. However, due to continuously increased types of products, the vehicle wheels have different size parameters with each other. Therefore, in order to improve the universality, a support tool with randomly adjusted parameters, such as the height, the pitch circle diameter, the supporting angle and the like, is required.

SUMMARY

An improved spraying support tool is provided, which may capable of, among other things, meeting on-line spraying requirements of special forged vehicle wheels with different pitch circle diameters, different heights and different sizes.

In one embodiment of the disclosure, an improved vehicle wheel spraying support tool is composed of a base plate, screws I, rotary sleeves, adjustment rods, supporting pins, locking nuts, screws II, screws III, an anti-rotation pin, a stationary sleeve, sliding pins, a flange and fixed plates. The base plate is connected with the lower end of the stationary sleeve through a thread, and an annular slot matching with the sliding pins is formed in the upper end face of the base plate; and the screws I are mounted on the base plate and are in contact with the lower end face of the stationary sleeve.

The flange is circular and is welded at a corresponding position of the lower part of the stationary sleeve, and an annular slot matching with the sliding pins is formed in the lower end face of the flange.

Each sliding pin is fixed at the upper end and the lower end of the corresponding rotary sleeve; the fixed plates are fixed on the rotary sleeves, and the screws III are mounted on the fixed plates; the adjustment rods match with the rotary sleeves, the tail ends of the adjustment rods are connected with the lower parts of the supporting pins through threads, the locking nuts are connected with the lower parts of the supporting pins through threads, and the locking nuts are positioned above the tail ends of the adjustment rods; each screw II is mounted at one end of the corresponding rotary sleeve; and the anti-rotation pin is welded at a central position of the interior of the stationary sleeve.

The rotary sleeves can randomly slide in the slot of the base plate and the slot of the flange through the sliding pins; and furthermore, the number of the rotary sleeves can be increased or reduced according to requirements, and angles among the supporting pins can be randomly adjusted.

During actual use, the rotary sleeves with random number are mounted in the slot of the base plate and the slot of the flange through the sliding pins according to the requirements; after the angles among the supporting pins are adjusted, the rotary sleeves are fixed through the screws III; the positions of the supporting pins can be adjusted to fit in vehicle wheels of different pitch circles by adjusting the positions of the adjustment rods in the rotary sleeves; and the vertical heights of the supporting pins can be adjusted through the threads of the lower parts of the supporting pins, and the supporting pins are locked through the locking nuts.

The improved vehicle wheel spraying support tool provided by the disclosure can meet the on-line spraying requirements of the special forged vehicle wheels with different pitch circle diameters, different heights and different sizes, not only has a simple structure and high universality, but also has the characteristics of safety, reliability, low manufacturing costs and the like.

Figure 1:
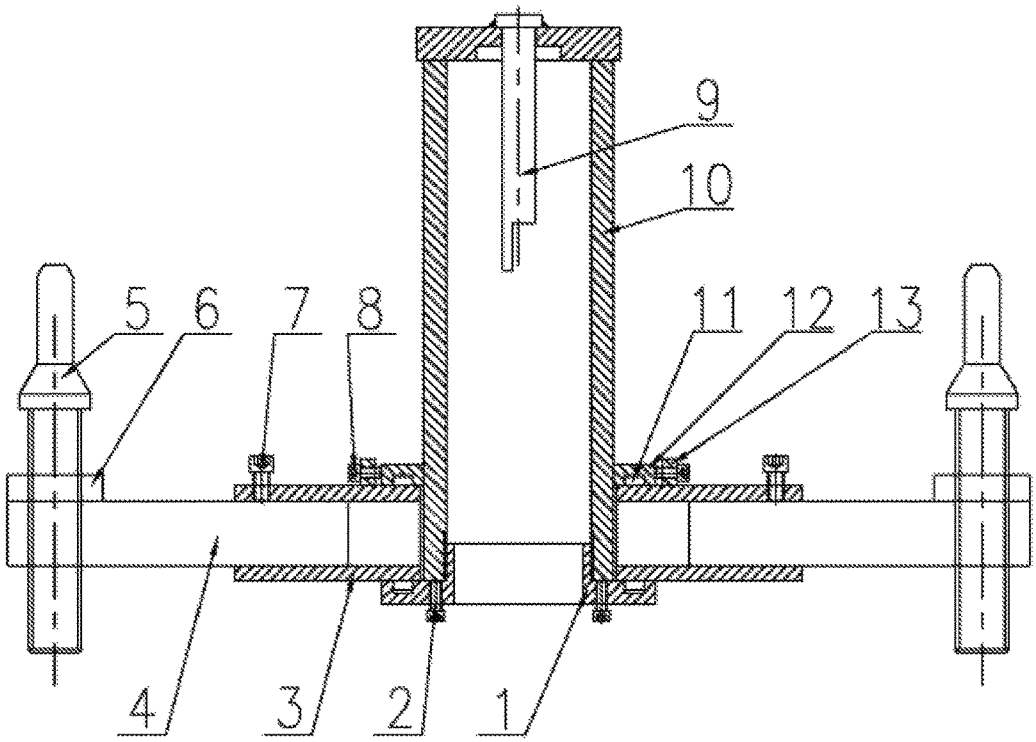
FIG. 1 is a front view of an adjustable vehicle wheel spraying support tool provided by the disclosure.
Figure 2:
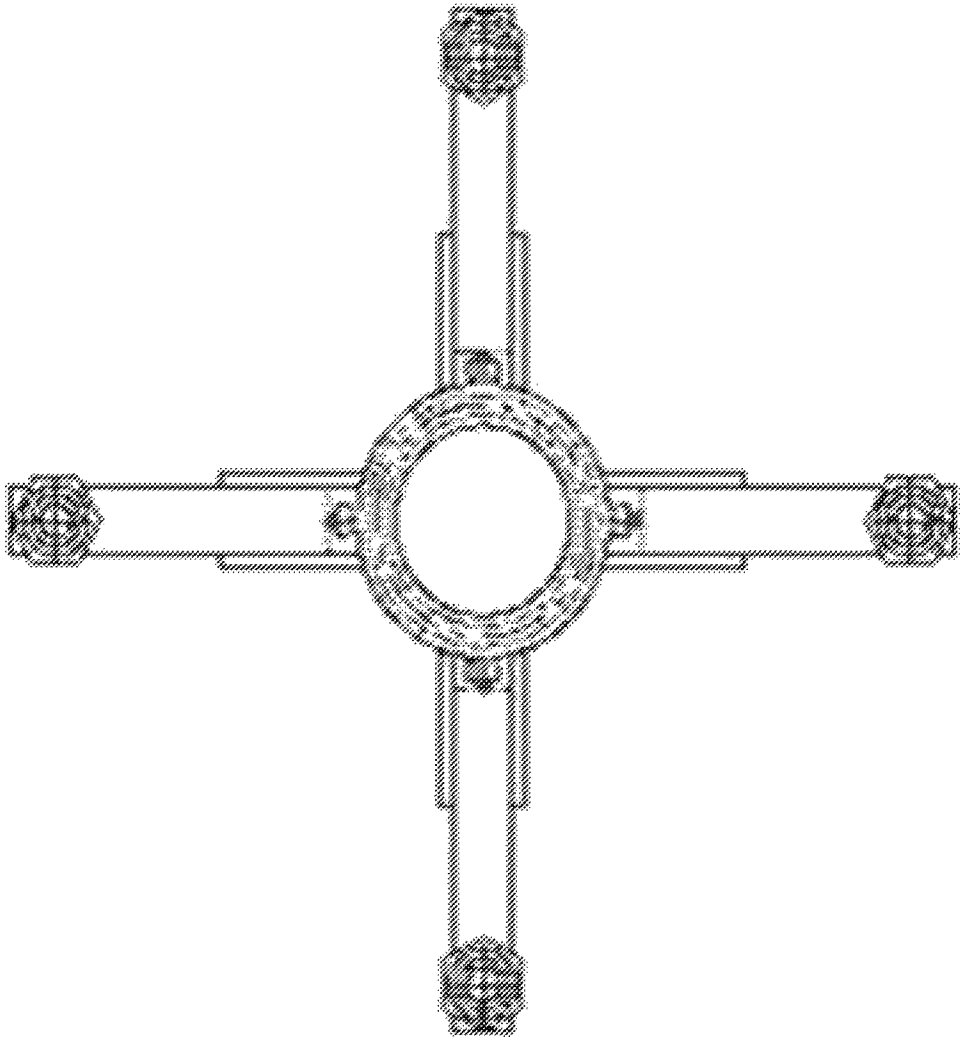
FIG. 2 is a top view of an adjustable vehicle wheel spraying support tool provided by the disclosure.
Figure 3:
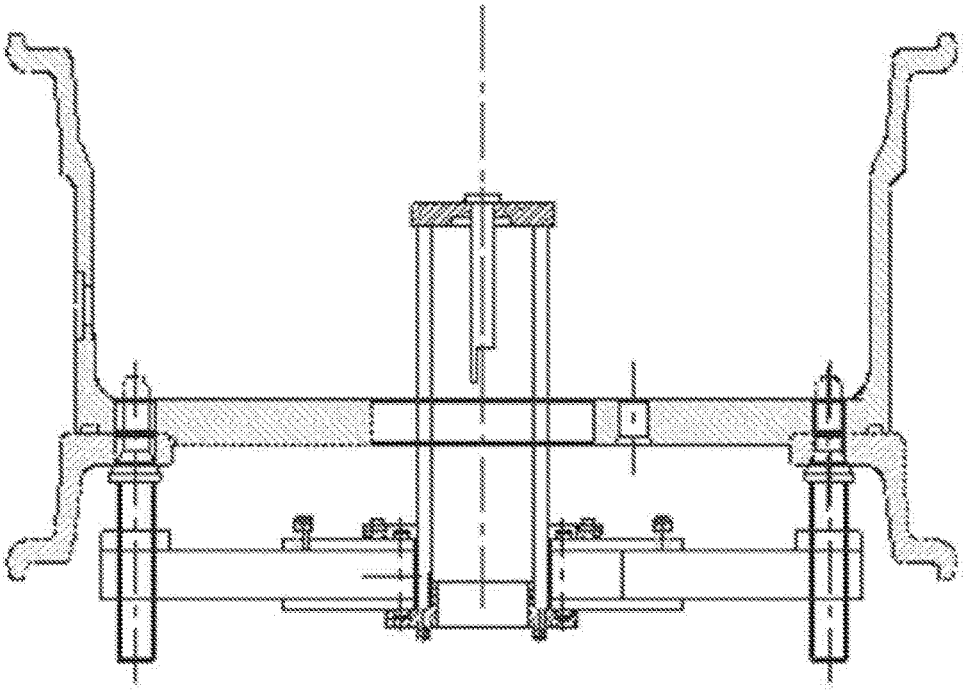
FIG. 3 is a front view of an adjustable vehicle wheel spraying support tool provided by the disclosure after a vehicle wheel is placed.

In the figures, numeric symbols are as follows: 1—base plate, 2—screw I, 3—rotary sleeve, 4—adjustment rod, 5—supporting pin, 6—locking nut, 7—screw II, 8—screw III, 9—anti—rotation pin, 10—stationary sleeve, 11—sliding pin, 12—flange, and 13—fixed plate.

DETAILED DESCRIPTION

In the following, the details and working conditions of a specific device provided by the disclosure are described in combination with figures.

An improved vehicle wheel spraying support tool is composed of a base plate 1, screws I 2, rotary sleeves 3, adjustment rods 4, supporting pins 5, locking nuts 6, screws II 7, screws III 8, an anti-rotation pin 9, a stationary sleeve 10, sliding pins 11, a flange 12 and fixed plates 13. The base plate 1 is connected with the lower end of the stationary sleeve 10 through a thread, and an annular slot matching with the sliding pins 11 is formed in the upper end face of the base plate 1; and the screws I 2 are mounted on the base plate 1 and are in contact with the lower end face of the stationary sleeve 10.

The flange 12 is circular and is welded at a corresponding position of the lower part of the stationary sleeve 10, and an annular slot matching with the sliding pins 11 is formed in the lower end face of the flange 12.

Each sliding pin 11 is fixed at the upper end and the lower end of the corresponding rotary sleeve 3; the fixed plates 13 are fixed on the rotary sleeves 3, and the screws III 8 are mounted on the fixed plates 13; the adjustment rods 4 match with the rotary sleeves 3, the tail ends of the adjustment rods 4 are connected with the lower parts of the supporting pins 5 through threads, the locking nuts 6 are connected with the lower parts of the supporting pins 5 through threads, and the locking nuts 6 are positioned above the tail ends of the adjustment rods 4; each screw II 7 is mounted at one end of the corresponding rotary sleeve 3; and the anti-rotation pin 9 is welded at a central position of the interior of the stationary sleeve 10.

The rotary sleeves 3 can randomly slide in the slot of the base plate 1 and the slot of the flange 12 through the sliding pins 11; and furthermore, the number of the rotary sleeves 3 can be increased or reduced according to requirements, and angles among the supporting pins 5 can be randomly adjusted.

During working, the rotary sleeves 3 with random number are mounted in the slot of the base plate 1 and the slot of the flange 12 through the sliding pins 11 according to the requirements; after the angles among the supporting pins 5 are adjusted, the rotary sleeves 3 are fixed through the screws III 8; the positions of the supporting pins 5 can be adjusted to fit in vehicle wheels of different pitch circles by adjusting the positions of the adjustment rods 4 in the rotary sleeves 3; and the vertical heights of the supporting pins 5 can be adjusted through the threads of the lower parts of the supporting pins 5, and the supporting pins 5 are locked through the locking nuts 6.

The invention claimed is:

1. An improved vehicle wheel spraying support tool, which comprises a base plate (1), screws I (2), rotary sleeves (3), adjustment rods (4), supporting pins (5), locking nuts (6), screws II (7), screws III (8), an anti-rotation pin (9), a stationary sleeve (10), sliding pins (11), a flange (12) and fixed plates (13), wherein the base plate (1) is connected with the lower end of the stationary sleeve (10) through a thread, and a first annular slot matching with the sliding pins (11) is formed in the upper end face of the base plate (1); the screws I (2) are mounted on the base plate (1) and are in contact with the lower end face of the stationary sleeve (10); the flange (12) is circular and is welded at a corresponding position of the lower part of the stationary sleeve (10), and a second annular slot matching with the sliding pins (11) is formed in the lower end face of the flange (12); each sliding pin (11) is fixed at the upper end and the lower end of the corresponding rotary sleeve (3); the fixed plates (13) are fixed on the rotary sleeves (3), and the screws III (8) are mounted on the fixed plates (13); the adjustment rods (4) match with the rotary sleeves (3), the tail ends of the adjustment rods (4) are connected with the lower parts of the supporting pins (5) through threads, the locking nuts (6) are connected with the lower parts of the supporting pins (5) through threads, and the locking nuts (6) are positioned above the tail ends of the adjustment rods (4); each screw II (7) is mounted at one end of the corresponding rotary sleeve (3); and the anti-rotation pin (9) is welded at a central position of the interior of the stationary sleeve (10).

2. The improved vehicle wheel spraying support tool according to claim 1, wherein the rotary sleeves (3) can randomly slide in the first annular slot of the base plate (1) and the second annular slot of the flange (12) through the sliding pins (11); and the number of the rotary sleeves (3) can be increased or reduced according to requirements, and angles among the supporting pins (5) can be randomly adjusted.

* * * * *